United States Patent [19]

Peschl

[11] Patent Number: 4,859,981

[45] Date of Patent: Aug. 22, 1989

[54] ELECTRICAL RESISTOR DEVICE

[75] Inventor: Hans P. Peschl, Hart/Graz, Austria

[73] Assignee: EBG Elektronische Bauelement Gesellschaft m.b.H., Kirchbach, Austria

[21] Appl. No.: 195,194

[22] Filed: May 18, 1988

[51] Int. Cl.[4] ..... H01C 1/012

[52] U.S. Cl. ..... 338/308; 338/195; 338/283

[58] Field of Search ..... 338/195, 308, 309, 283, 338/287

[56] References Cited

U.S. PATENT DOCUMENTS

| | | | |
|---|---|---|---|
| 4,132,971 | 1/1979 | Caddock, Jr. | 338/195 X |
| 4,146,867 | 3/1979 | Blangeard et al. | 338/195 |
| 4,386,460 | 6/1983 | Klockow | 338/195 X |

FOREIGN PATENT DOCUMENTS

| | | | |
|---|---|---|---|
| 1474731 | 5/1977 | United Kingdom | 338/195 |

OTHER PUBLICATIONS

Nickel, *IBM Technical Disclosure Bulletin,* "Element Trimming Fusible Link", vol. 26, No. 8, Jan. 1984, p. 4415.

Kiang, et al., *IBM Technical Disclosure Bulletin,* Folded Pattern for Film Resistor With Trimmable Elements in Binary Sequence, vol. 5, No. 4, 9/82 pp. 2003–2004.

*Primary Examiner*—C. L. Albrition

*Attorney, Agent, or Firm*—William E. Cleaver

[57] ABSTRACT

The present device is an electrical resistor component which includes a cylindrical substrate of non-electrical conducting material. A meandering path (strongly resembling a plurality of hairpins laid end to end) of electrical conducting (but at the same time resistant to electrical current) material is secured substantially around the length dimension surface of the cylindrical substrate. The meandering path is arranged so that there is separation area of the cylindrical substrate surface which separates the turn around bends of the path which face each other. This last mentioned area has a limited amount of electrical conducting material located therein. In the separation area there are included connecting deposits of the electrical conducting material which are connected to the turnaround bends. The connecting deposits serve to provide parallel paths and thus initially reduce the electrical resistance value of the overall electrical resistor component. When the leads of the connecting deposits are severed the resistance value can be increased to a required value. In addition, the ends of the meandering path are terminated in end areas of electrical conducting material which also can be helically cut and/or removed to trim the resistance value of the resistor component to meet a specified electrical resistance value.

8 Claims, 1 Drawing Sheet

ELECTRICAL RESISTOR DEVICE

BACKGROUND OF THE DISCLOSURE

It is well understood that if the electrical current path of an electrical resistor component is helically formed around a cylindrical substrate (which is a very popular form of electrical resistor component) that there will be an inductance effect that will delay signals passing through such a resistor component. Accordingly, electrical resistor components have been designed which provide a meandering path of electrical conducting material secured to a flat substrate. In such devices the major part of the meandering path has segments which lay parallel to one another and which carry electrical current flowing in opposite directions so that the magnetic flux created by such current in one segment "bucks out" or cancels the magnetic flux created by such current in an adjacent parallel leg. Hence, the inductance effect is nullified. More recently there has been an effort to lay out the meandering path on a cylindrical substrate as described in U.S. Pat. Nos. 3,858,147 and 4,132,971. In those devices the meandering path is secured to the substrate by silk screening so that the thickness of the path is built-up in a layered fashion. With these last mentioned devices, in order to trim the electrical resistance value to a desired value, the depth or thickness of the electrical conducting material is lapped or removed. By cutting down the depth of the material, the path is narrowed and provides a greater electrical resistance value. While this arrangement has been somewhat satisfactory, the practice of lapping very often generates weak sections along the electrical conducting material path. The weak sections arise because the crystaline structure of electrical conducting material is such that it tears off in response to the lapping technique. The present device takes advantage of the cancelled flux found in a meandering path on the cylindrical substrate, but provides other means for trimming the resistance value of the component so that the component has a desired electrical resistance value without creating weak sections.

SUMMARY OF THE DISCLOSURE

The present electrical resistor component is designed to be used wherever cylindrical type electrical resistor components are used, but at the same time it is designed to suffer from a minimum of inductance impedance. In addition, the design of the present electrical resistor enables the manufacturer to produce electrical resistor components which have designated electrical resistance values without producing electrical resistors which have uneven depth profiles and therefore weakened sections along the path of the electrical conducting material. The present electrical resistor component comprises a cylindrical substrate of ceramic (non-electrical conducting) material. Secured to the length dimension surface of the cylindrical substrate is electrical conducting material which is laid out in a meandering path. Actually, the meandering path resembles a sinusoidal configuration or a plurality of hairpins laid end to end. Where the turnaround bends of the hairpin configurations (or the apexes of the sinusoidal configuration) face each other, there is created a separation area which has a limited amount of deposits of the electrical conducting material. However, in the separation area there are some connecting deposits which have connecting legs connected to a number of the apexes of the meandering path. The arrangement of the connecting deposits, just described, provides parallel paths in certain areas of the electrical resistor component and thus the overall electrical resistance value is lower initially then the rated value or the desired value. By severing some of the connecting legs of the connecting deposits, the electrical resistance value of the component is increased. In addition, the meandering path is terminated in two end sections (one section located on each end of the resistance component) of the cylindrical substrate. Portions of the end sections can be incrementally removed to alter the value of the electrical resistance of the resistor component and this last form of alteration represents a technique for fine trimming the electrical resistance value. Accordingly, the present electrical resistor component has a minimum of inductance impedance while it offers a basis for readily manufacturing the resistor component to provide a designated electrical resistance value.

The features and objects of the present invention will be better understood in view of the following description taken in conjunction with the drawings wherein.

Figure 1:
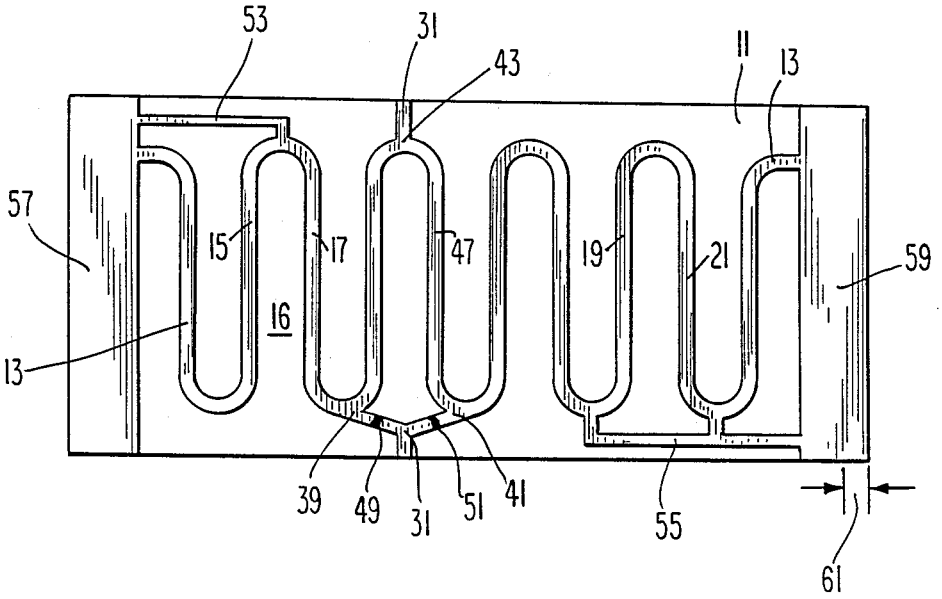
FIG. 1 is a "rolled out" view of an electrical conducting path which is deposited on the substrate.

Consider FIG. 1 where there is shown a "rolled out" version of the meandering path. In FIG. 1 there is depicted a substrate 11 upon which there is deposited a meandering path 13 of electrical conducting material. The ceramic substrate 11, in FIG. 1, has been cut lengthwise and opened up into a flat configuration. The meandering path 13 of electrical conducting material is deposited by a silk screening technique or by a photoresist technique or by some other suitable means of depositing such material. The electrical conducting material in the preferred embodiment is a ruthenium system with several additives to control the required temperature coefficient. As can be gleaned from FIG. 1, the parallel legs (such as legs 15 and 17 or legs 19 and 21 by way of example) of the meandering path 13 are arranged such that as electrical current passes through leg 15, around the bend and back through leg 17 the magnetic flux across the spaced 16 is "bucked out" or cancelled or nullified. Hence, the flux generated by the electrical current in leg 15 does not intertwine leg 17 to induce a current therein. In the same way, the flux generated by the electrical current in leg 17 is "bucked out" or nullified in space 16 so that the flux generated by the current in leg 17 does not induce electrical current in leg 15. The nullification of induced current occurs for each of the legs such as legs 19 and 21 and hence the resistor components shown in FIG. 1 and FIG. 2 are virtually free of inductance impedance.

Figure 2:
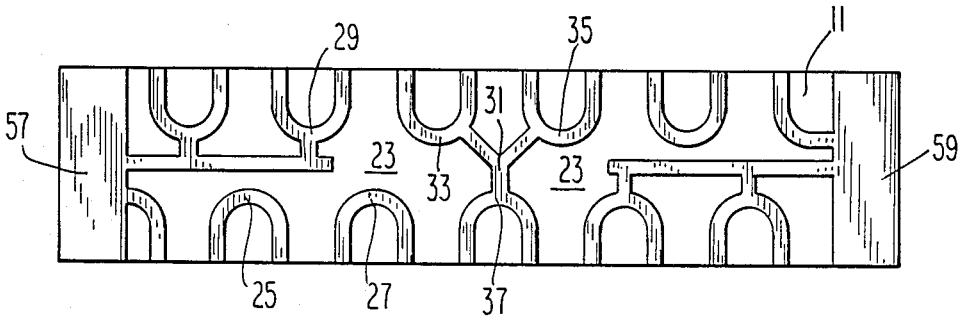
FIG. 2 is a pictorial view of the present resistor component with more turn arounds than shown in FIG. 1.

As can be seen in FIG. 1 and better seen in FIG. 2, in the separation space 23 between the turnaround bends 33, 35 and 37, by way of example, there is located a Y shaped connecting deposit means 31. As can be seen, the connecting deposit 31 has three legs which are respectively connected to the three turnaround bends 33, 35, and 37. As can be better appreciated in FIG. 1, there are two parallel paths which lie between the points 39 and 41. One of those parallel paths is through the connecting deposit while the second path is through the legs 45 and 47. There are two parallel paths between the points 39 and 43 with one of those paths being through the connecting deposit 31 and the other being through the leg 45. There are two parallel paths between the point 43 and 41 with one of those paths being through the connecting deposit 31 and the other being through the leg 47. As is apparent from FIG. 1, if the connecting deposit 31 is severed at point 49 then all of the current passing through the resistor component must pass through the leg 45 and hence the resistance value of the component is dramatically increased. In a similar way if the connecting deposit 31 is severed at point 51 then all the current passing through the resistor component must pass through the leg 47 which also provides for an additional resistance value for the component. If, indeed, the connecting deposit is severed at points 49 and 51, then the current passing through the resistor component must go through both of the legs 45 and 47 and the resistance value of the component is dramatically increased. The other two connecting deposits 53 and 55 can be used in the same fashion as that described with the connecting deposit 31 and it becomes apparent that the overall resistance value of the electrical resistor component can be increased in some substantial way by selectively severing certain of the connecting legs of the connecting deposits. In a preferred embodiment the connecting deposits are located so that the increased resistance values can be in digital amounts of 5% to 12%.

As can be further seen in FIGS. 1 and 2, the ends of the substrate 11 have strips of electrical conducting material such as end strips 57 and 59 secured thereto. The end strips not only serve as the termination structure for the electrical conducting path but they serve as a means for doing a fine trim of the electrical resistance value so that the component can be fabricated to a designated resistance value. After the manufacturer has made a large correction of the resistance value by severing certain of the connecting deposit legs, then the end strips are incrementally ground away or helically cut so that the resistance value reaches the designated value. In a preferred embodiment the end strips can be cut to increase the resistance to as little as 0.01%. For instance, if material from the end strip is removed by way of helically cutting along the width 61 (and parallel to the leg 21), then the resistance value will be increased and as the material from strip 61 is removed, the fabricating system will measure the electrical resistance from end strip 57 to the end strip 59. As an end strip is being ground away, the resistance value increases and when the electrical resistance value reaches the designated value the grinding or cutting process will stop. The change of resistance is a function of the material removed along the width 61 and therefor the change can be adjusted by setting 61 after measuring the resistance value before the fine trimm cut. It becomes apparent then that the present electrical resistor component has a means for effecting a large change in resistance as well as a small change so that the manufacturer can readily produce a resistor of a given electrical resistance value.

After the electrical conducting material is properly arranged by severing the connector deposit legs and by trimming the end pieces, the overall resistor component is fitted with two end caps of a suitable metal such as copper and the electrical resistor is lacquered or dipped in epoxy resin in order to protect the electrical conducting material which is secured to the substrate. The above described electrical resistor component has a minimum of inductance impedance, has a means for effecting large, electrical resistance changes and has a means for effecting an incremental increase in electrical resistance by trimming the end segments. All of the foregoing enhances the desirability of the present electrical resistor component.

I claim :

1. An electrical resistor means comprising in combination: cylindrical substrate means having a circumferential surface and formed of electrically non-conductive material; electrical resistance material secured around a major portion of said circumferential surface of said cylindrical substrate and formed in a meandering sinusoidal path having a plurality of full wave patterns each with a first half wave apex and an associated second half wave apex and further with each first half-wave apex being separated from its associated second half-wave apex by a separation area of said cylindrical substrate surface; at least one interconnecting pattern of said electrical resistance material having at least first and second connecting legs and secured to said separation area with said first leg being connected to the first half-wave apex of a selected full wave pattern and said second leg being connected to the associated second half wave apex whereby a parallel electrical conducting path is formed between said first half-wave apex and said second half-wave apex.

2. An electrical resistor means according to claim 1 wherein said at least one interconnecting pattern is shaped substantially in the form of the letter Y and wherein each of the three extremities of the Y shaped interconnecting pattern is connected to a different but sequential half-wave apex.

3. A electrical resistor means according to claim 2 wherein there is further included at least one end section formed of said electrically resistance material and disposed to be connected to at least one end of said meandering sinusoidal pattern and further formed to completely surround the circumferential surface at a section at the end of said cylindrical substrate means whereby the electrical resistance value of said electrical resistor means can be altered by incrementally removing a portion of said end section.

4. An electrical resistor means according to claim 2 wherein said cylindrical substrate has first and second ends and where there are further included first and second end sections each formed of said electrically resistance material and disposed to be respectively connected to said first and second ends of said cylindrical substrate and wherein said first and second end sections are further connected to opposite ends of said meandering sinusoidal pattern and further formed to completely surround said circumferential surface at said first and second ends of said cylindrical substrate means whereby the resistance value of said electrical resistor means can be altered by removing a portion of said first and second end sections.

5. An electrical resistor means according to claim 1 wherein said cylindrical substrate means has first and second ends and wherein there are further included first and second end sections, each formed of said electrically resistance material and formed to be connected to said meandering sinusoidal pattern and wherein there is further included a first interconnecting pattern connected to said end section and to at least one of said half-wave apexes of said meandering sinusoidal pattern.

6. An electrical resistor means according to claim 5 wherein said interconnecting pattern is connected to said first end section and to first and second half-wave apexes of said meandering sinusoidal pattern.

7. An electrical resistor means according to claim 5 wherein there is further included a second interconnecting pattern connected to said second end section and further connected to at least one half-wave apex of said meandering sinusoidal pattern.

8. An electrical resistor means according to claim 7 wherein there is further included an interconnecting pattern which is substantially shaped like the letter Y and wherein each of the three extremities of said Y shaped interconnecting pattern is connected to a different but sequential half-wave apex.

* * * * *